United States Patent [19]

Scoggins

[11] Patent Number: 4,750,863

[45] Date of Patent: Jun. 14, 1988

[54] FAN SHROUD FILTER

[75] Inventor: Glenn Scoggins, Yolo, Calif.

[73] Assignee: G & H Enterprises, Yolo, Calif.

[21] Appl. No.: 60,645

[22] Filed: Jun. 11, 1987

[51] Int. Cl.[4] ..... F04D 29/70

[52] U.S. Cl. ..... 416/14.6 R; 416/5; 416/247 R; 55/385 A

[58] Field of Search ..... 416/146 R, 5, 247 R, 416/170 C; 55/385 A, 385 R, 473

[56] References Cited

U.S. PATENT DOCUMENTS

| | | | |
|---|---|---|---|
| 2,790,510 | 4/1957 | Brabec | 416/5 X |
| 3,422,263 | 1/1969 | Asahina | 416/146 R X |
| 4,064,427 | 12/1977 | Hansen et al. | 416/5 X |
| 4,422,824 | 12/1983 | Eisenhardt | 416/146 R X |
| 4,514,197 | 4/1985 | Armbruster | 55/385 A X |
| 4,560,395 | 12/1985 | Davis | 55/473 X |
| 4,596,585 | 6/1986 | Moeller et al. | 55/385 A X |
| 4,620,869 | 11/1986 | Goossens et al. | 55/385 A |
| 4,629,482 | 12/1986 | Davis | 55/385 A |
| 4,657,485 | 4/1987 | Hartwig | 416/5 X |
| 4,676,721 | 6/1987 | Hardee | 416/146 R |

FOREIGN PATENT DOCUMENTS

| | | | |
|---|---|---|---|
| 612604 | 4/1935 | Fed. Rep. of Germany | 416/146 R |
| 862970 | 1/1953 | Fed. Rep. of Germany | 416/5 |
| 2302243 | 7/1973 | Fed. Rep. of Germany | 416/146 R |
| 593806 | 9/1925 | France | 416/146 R |
| 824791 | 2/1938 | France | 416/247 R |
| 267334 | 6/1950 | Switzerland | 416/146 R |

*Primary Examiner*—Everette A. Powell, Jr.
*Attorney, Agent, or Firm*—Mark C. Jacobs

[57] ABSTRACT

A filter device for use in conjuction with a ceiling fan, for removal of smoke and other pollutants from the room air during the operation of the fan. The device is affixed to the ceiling and to the post from which the fan housing is suspended, such that air containing pollutants that is pulled upward across the diameter of the fan blades, passes through the device.

12 Claims, 4 Drawing Sheets

FAN SHROUD FILTER

BACKGROUND OF THE INVENTION

Ceiling fans that passed from vogue when room conditioners appeared have been making a strong comeback in America and other countries due both to the high cost of energy and to the desire of the public for cleaner air. Today however, ceiling fans are being used in conjunction with air conditioners, as well as at times when air conditioners, though present are not being employed. Thus ceiling fans are being employed as air circulators during both warm, but not hot days, as well as on winter days. In the winter, the blade rotation is reversed, such as to force the warm air downward into the room to thereby permit lower thermostat settings.

Whereas room air conditioners, and to a degree central air conditioners include a filter mechanism to remove gross particles from the air, there has not to date been any type of filter device to be used in conjunction with ceiling fans to remove smoke, cooking odors, flatulation gas, and dust among other pollutants.

There is a need therefore for an easy to install filter device for use with ceiling fans. Such a need is filled by the device of this invention.

It is an object therefore of this invention to provide a filter device for use with ceiling fans.

It is another object to provide an easy to install retrofitable filter device that mounts on a ceiling fan.

An additional object is to provide a filter device that employs replaceable filter media.

A further object is to provide a filter device that can remove odors, pollutants and smoke from a room during periods of operation of the ceiling fan.

Other objects of the invention will in part be obvious and will in part appear hereinafter.

The invention accordingly comprises the apparatus possessing the construction, combination of elements and arrangement of parts which are exemplified in the following detailed disclosure, and the scope of the application of which will be indicated in the claims.

For a fuller understanding of the nature and objects of the invention, reference should be had to the following detailed description taken in conjunction with the accompanying drawings.

SUMMARY OF THE INVENTION

A filter device for superposed mounting over the blades of a ceiling fan and to the ceiling, for the removal of air contaminants during the operation of the fan. The device features replaceable filter media.

DESCRIPTION OF THE PREFERRED EMBODIMENT

Figure 1:
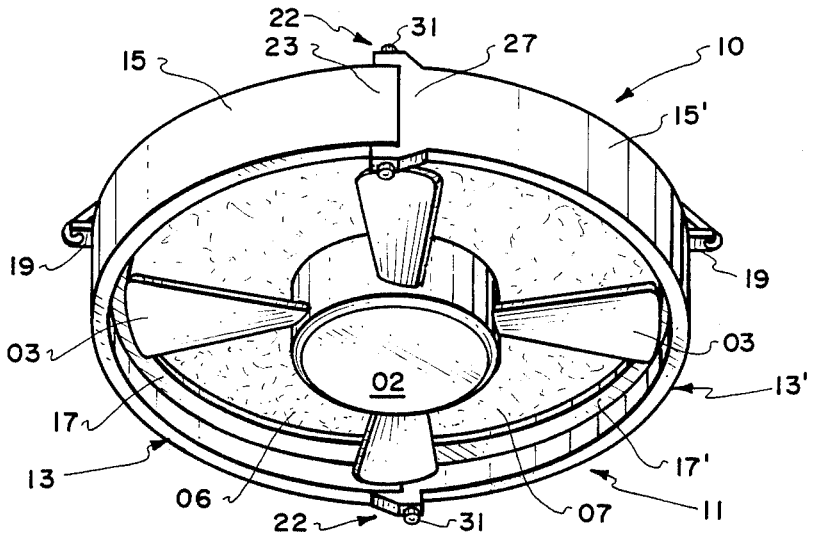
FIG. 1 is a bottom perspective view showing the device of this invention mounted over a ceiling fan.

The device 10 of this invention is seen in a bottom perspective view mounted in place over a typical ceiling fan in FIG. 1. Such fans are readily available in the marketplace from such vendors as Sears Roebuck, Montgomery Ward, Hunter Vornado and others. They include a plurality of blades, usually 3, 4 or 5 of a length of from about 18 to about 27 inches. Thus the fan is referred to as a 36 or 54 inch diameter fan, based on the diameter of the air path or cyclone created by any two axially aligned blades. The blades extend horizontally from a motor housing, which motor housing depends downward from the room ceiling on a tubular conduit containing the electrical wire leading from the ceiling outlet. Obviously the instant device can be used with any diameter fan, the 36 and 54 inch ones being but examples.

Figure 7:
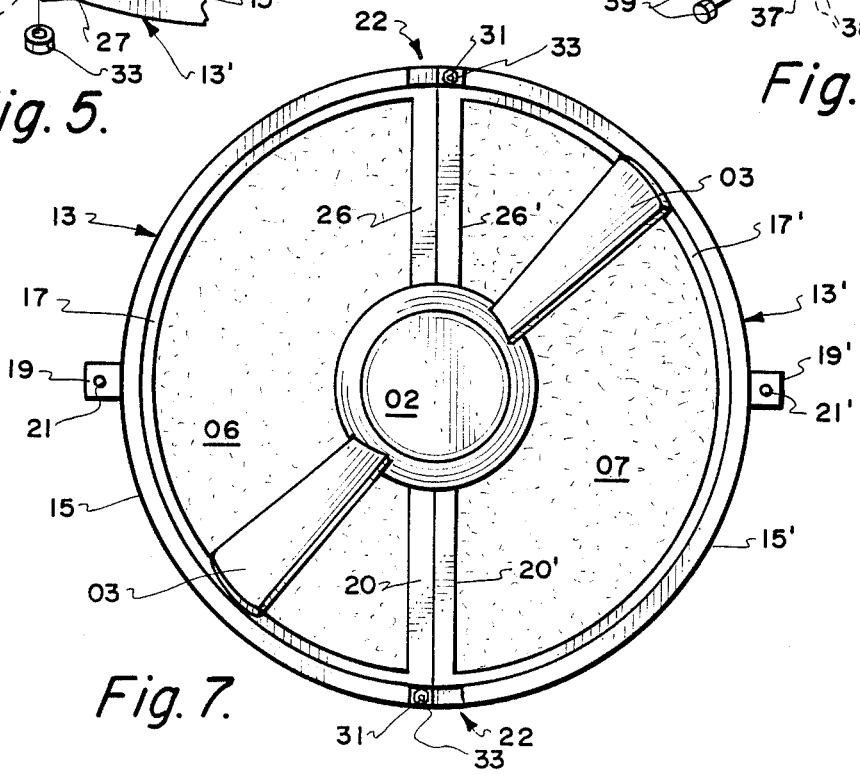
FIG. 7 is a bottom plan view of this invention, less the ceiling mount means.
Figure 8:
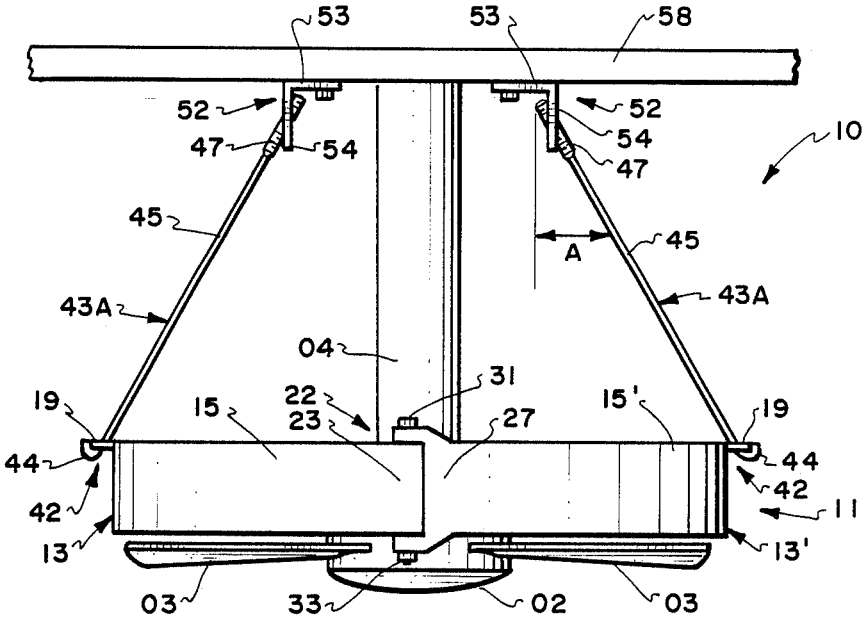
FIG. 8 is an elevational view of the device of this invention.

Thus of the ceiling fan components mentioned above, the motor housing 02 is seen in FIG. 7 as are fan blades 03, while the tubular conduit 04 is seen in FIG. 8, along with the motor housing.

Figure 2:
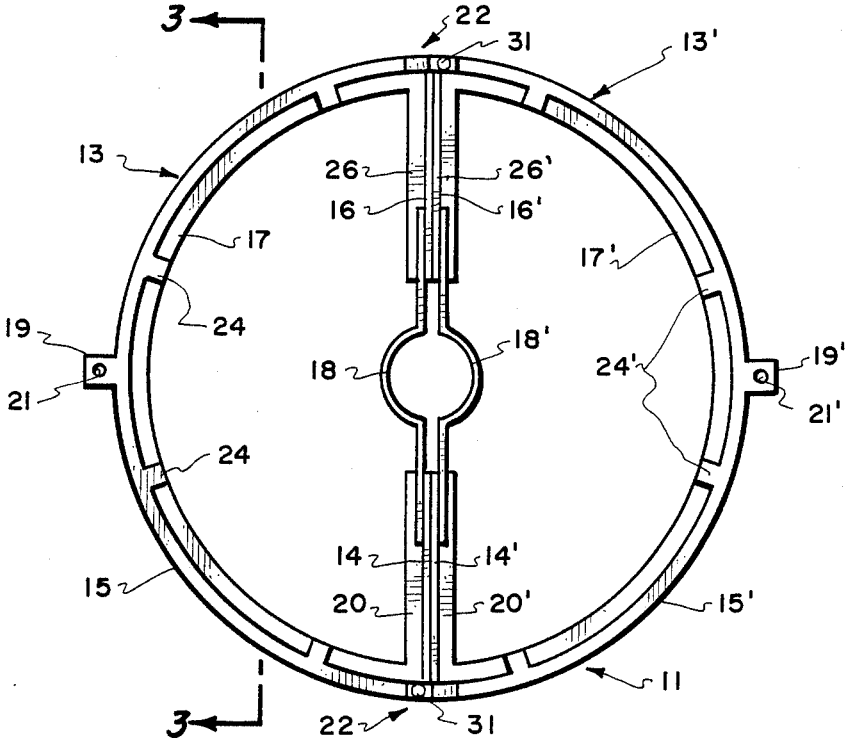
FIG. 2 is a top plan view of the housing portion of this invention filter not shown.

Having set the scene, the discussion now turns, to the details of the device of this invention. Reference therefore is made to FIG. 2, wherein the main body portion 11 is seen to comprise a pair of semi-annular portions 13, 13'. Each of these features a vertical upstanding semicircular outer wall 15, 15', from each end of which there depends inwardly in the same horizontal plane a pair of spaced axially aligned inner walls 16, 16' and 14, 14'. The walls 14 and 16 and 14', 16' are joined by a smaller in diameter semicircular connector wall 18, and 18' respectively. The diameter across the open end of 18, 18' which corresponds to the space between 14, 16 and their prime counterparts depends on the diameter of the motor housing 02, in that a reasonably snug fit around said housing 02 is desired for stability of device 10.

Disposed normal to the elevation of wall 15, 15' and spaced upwardly slightly from the bottom of walls 15, 15' is flange 17, 17'. This flange extends inwardly from the inside surface of wall 15 from about ½" to 2" as may be desired to serve as a support for the filter medium. See FIGS. 2 and 3.

Figure 3:
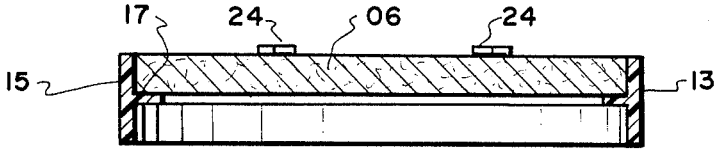
FIG. 3 is a sectional view taken along line 3—3 of FIG. 2. The filter medium not shown in FIG. 2 is shown disposed within the housing.
Figure 4:
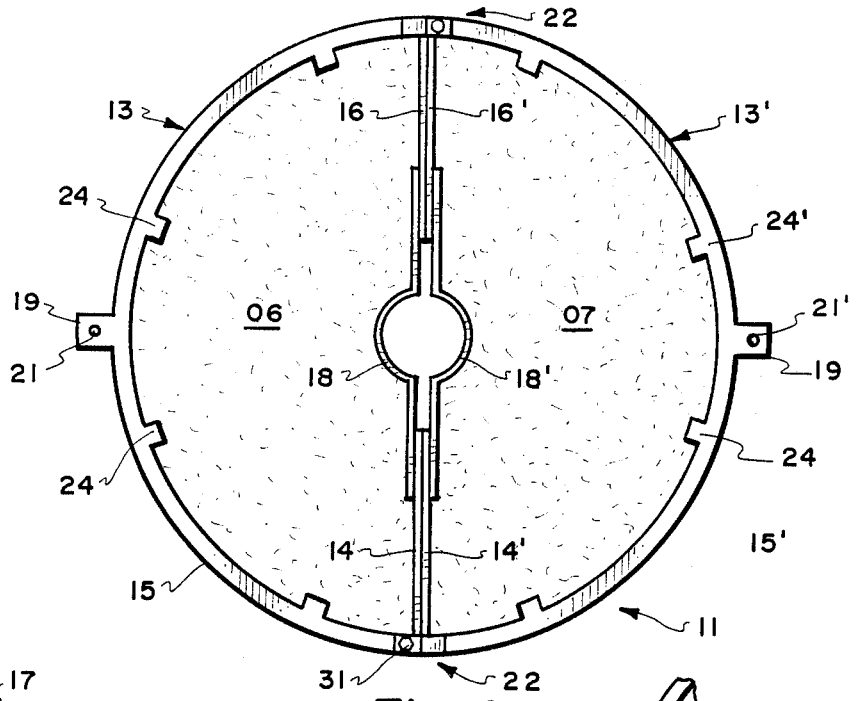
FIG. 4 is a top plan view of the housing portion with the filter medium therein.

A series of spaced finger-like projections designated as fingers 24 extend inwardly from at or near the top edge of wall 15. The exact disposition of fingers 24 will depend upon the elevation of the outer wall 15, 15' and the thickness of the filter to be employed. These fingers serve to confine the filter medium within the main body portion 11, by preventing the upwardly moving air from lifting the filter medium off the flange 17. While fingers 24 are shown in FIGS. 3 and 4, other confining means, such as an inwardly extending circular lip is also contemplated, but at higher cost.

Figure 9:
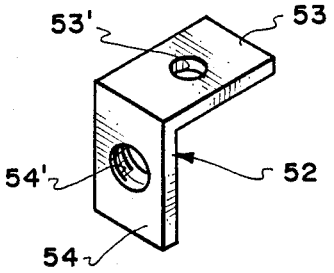
FIG. 9 is a closeup view of a first embodiment of a mount means portion of this invention.
Figure 10:
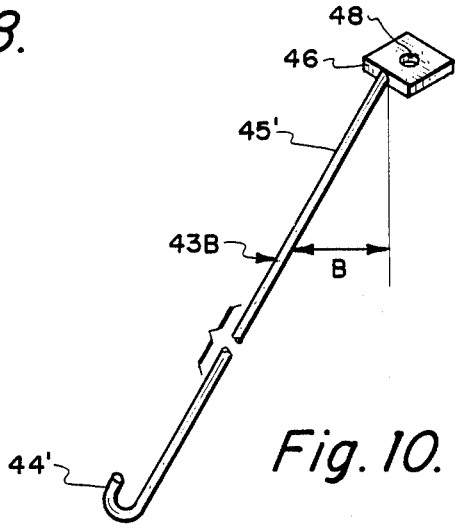
FIG. 10 is a closeup view of a second mount means portion of this invention.

Mounted at about the midpoint around the periphery of the walls 15, 15'' are a pair of flat outward extending tabs, 19, 19'. These extend oppositely from the direction of the flanges 17, 17'. Each tab 19, 19' has a central throughbore 21, 21' sized to receive the mount means shown in either FIG. 9 or 10, both of which will be discussed below.

As is seen in FIG. 2, the main body portion 11 comprises two semi-annular portions 13, 13'. These are attached to each other by one of two different junction means designated 22, the first of which 22A is depicted in FIG. 5, while the second of which is depicted in FIG. 6 and designated 22B.

Figure 5:
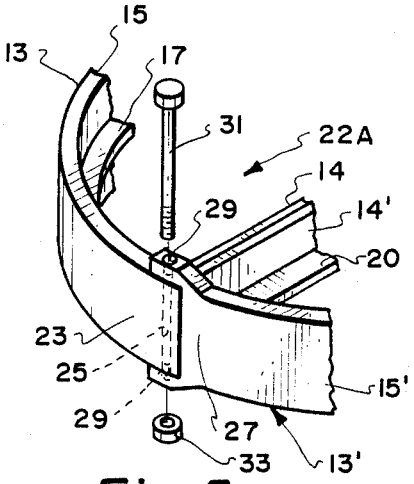
FIG. 5 is a closeup view depicting a first mode of attachment for the two segments of the housing to each other.

In FIG. 5 it is seen that one of the semi-annular portions 13 includes an arm 23 that may be fixedly, pivotally, or flexibly attached to wall 15, as may be desired and extends forwardly from the connection of wall 15 with wall 14. Arm 23 includes a vertical throughbore 25. Attached to the opposed end of portion 13' is a clevis 27 having a pair of aligned throughbores 29 through which a bolt 31 may be disposed. Bolt 31 passes through the first bore 29, bore 25 and then second bore 29, after which nut 33 is secured thereon. Thus arm 23 is held in place in clevis 27 to attach portion 13 to portion 13'.

While only one of such junctions 22A has been described, it is understood that such a junction means 22A is disposed at each end of the periphery of walls 15 and 15', one part on each wall. In addition, the clevis 27 can be on either wall 15 or 15' as can the arm 23. While only one bolt 31 and nut 33 are shown here for ease of understanding, the use of two is recommended for stability.

Figure 6:
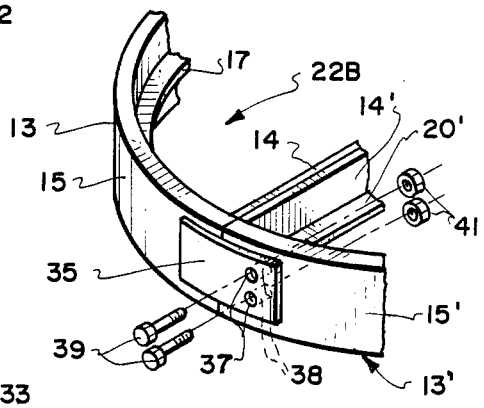
FIG. 6 is a closeup view depicting a second such mode.

In FIG. 6 a second mount means 22B is shown. Here a flange 35 is mounted as by any conventional means, screws, glue etc. onto wall 15 or 15' on the outside thereof to extend forwardly away from wall 14. The overlap of flange 35 may be of 1" to 3" or so as may be deemed desirable. Each flange 35 includes a pair or more of through bores 37 adapted to be aligned with corresponding throughbores 38 in the opposed semi-annular portion's wall. The bores 38 are disposed at a location such that the two walls 14, 14' will be in an almost abutting relationship. Bolts 39 pass throughbores 37 and 38 to secure each semi-annular portion to the other, and are retained in position by bolts 41.

Again while only one such mount means 22B has been described, it is understood that one of such is disposed on each end of the periphery of walls 15, 15'. Also, it matters not which wall 15 or 15' has the flange 35 and which has the pair of vertically aligned bores 38.

Other junction means 22 are contemplated and the two shown here are merely illustrative of this aspect of the invention.

As is seen in FIG. 8, the entire invention is shown utilizing J-shaped hook 43A to secure main body portion 11 to the ceiling 58. The mount means 43A includes a hooked end 44, a shaft 45 and a threaded end 47 at the opposite end of the shaft from the hooked end. This mount means is used in conjunction with mount plate 52, which can be inverted L shaped as shown also in FIG. 9 or inverted T shaped as may be desired. Mount plate includes a first portion 53 having a bore therein 53' adapted to receive a nail, molly bolt or screw not shown to attach it to the ceiling 58. Portion 54, which depends downwardly therefrom also has a threaded bore 54' therein. This bore is angularly inclined to receive the threaded end 47 of means 43A. The angle of the threaded bore is related to the radius of the main body portion 11. Angle "A" per FIG. 8 will increase as the diameter of body 11 increases. Obviously end 47 should be threaded into bore 54' prior to the attachment to tab 19 at bore 21.

Figure 13:
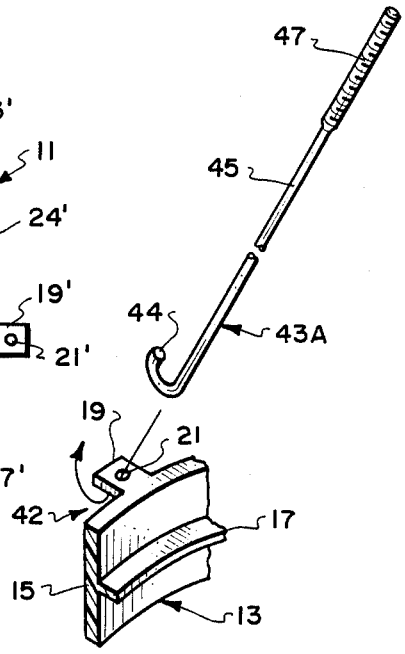
FIG. 13 is a closeup view of one portion of the invention.

As a variant to the use of tab 19, the wall 15 can be bored at appropriate locations as at 42 per FIG. 13 to receive the hooked end 44.

Figure 11:
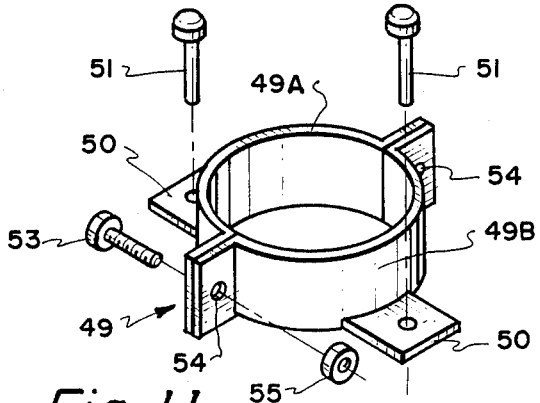
FIG. 11 is a perspective view of a collar to be employed with the mount means of FIG. 10.
Figure 12:
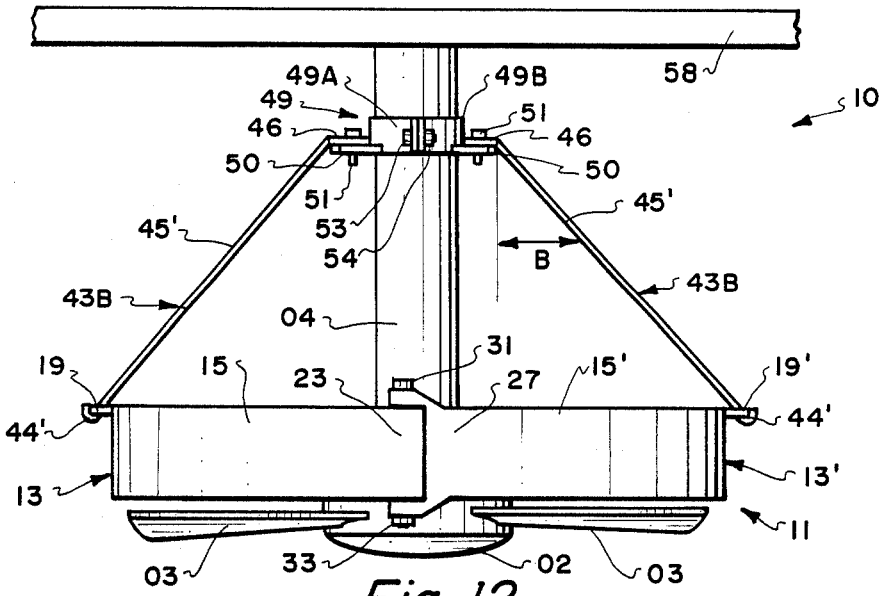
FIG. 12 is an elevational view of the first embodiment of this invention.

In FIG. 12 an alternative mounting is shown. Here mount means 43B shown in FIG. 10 and collar 49 shown in FIG. 11 is employed. Mount means 43B includes a hooked end 44' and a shaft 45' and a flat plate 46 fixed or preferably bendable to a needed angle "B" per FIG. 10. Angle "B" is also related to the diameter of main portion 11. As the diameter increases so does angle "B". Flat plate 46 includes a central bore 48 sized to receive pin 51 shown in FIG. 11.

Collar 49 is comprised of two pipe clamp members each of which has a curved section 49A and a pair of opposed spaced outwardly extending extensions 49B. Each curved section 49A has a tab 50 mounted thereon normal to the radius of curvature thereof. Each tab 50 has an upstanding pin 51 thereon. The two extensions 49B each have a bore 54 therein to receive a bolt 53 which is secured by nut 55. Only one such bolt and nut combination is shown here however. The two members of 49 are intended to be bolted together tightly around conduit 04 to form a friction fit at a suitable location thereupon, near the ceiling. See FIG. 12.

In FIGS. 2 and 3 there are seen the flanges 17, 17', 26, 26', and 20, 20' for holding the two half discs of foam used to adsorb the odors and pollutants. The two half discs of foam are seen from the top in FIG. 4, and are designated 06 and 07. They are also seen in the bottom view FIG. 7, wherein only two of the fan blades 03 have been included for ease of understanding.

Figure 15:
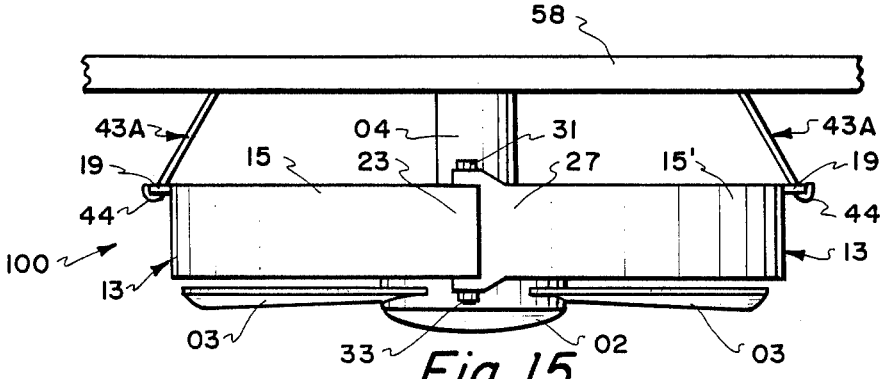
FIG. 15 is a view similar to FIG. 8 of the variant of FIG. 12.

The embodiment of the invention shown in FIG. 15 and designated 100 is in almost all aspects the same as embodiment 10. Therefore since like numbers refer to like parts, duplication of discussion will not take place.

In FIG. 15, it is seen that the fan is of what is known in the trade as "a hugger". That is, it is disposed relatively close to the ceiling. Thus the tubular conduit 04' is perhaps 6 inches or less in elevation. Device 100 therefore rests not on top of the motor housing 02 as in FIG. 12, but it surrounds the motor housing, and is disposed around the housing 02. Since tubular conduit 04' is short, mount means 43A of FIGS. 9 & 13 or another suitable mount means is to be used.

Figure 14:
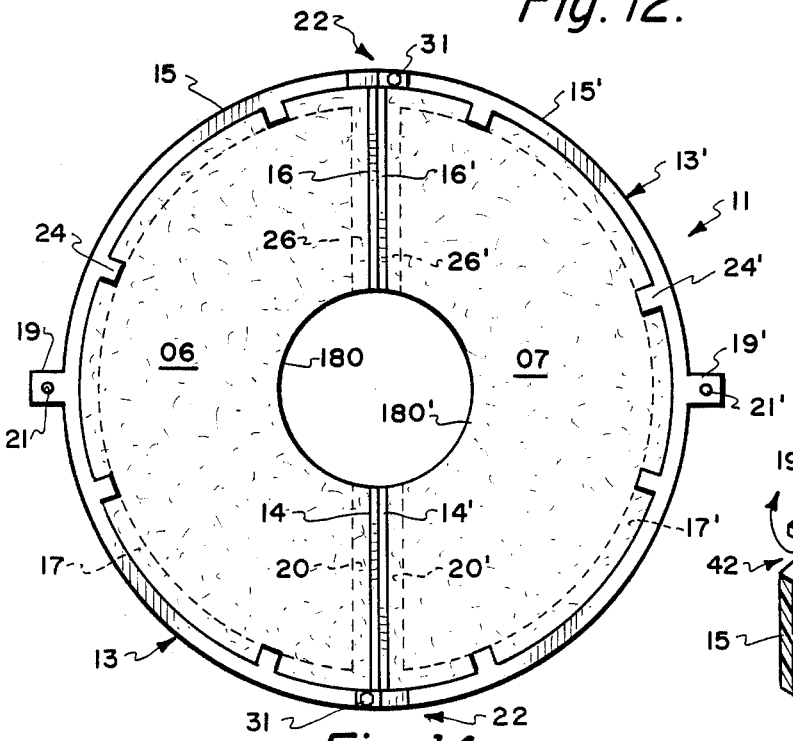
FIG. 14 is a view similar to FIG. 2 but for a variant embodiment.

Turning now to FIG. 14, it is seen that this view is similar to FIG. 2 but for the inner edges 180 and 180' of each of the two filter segments. By keeping walls 14, 14' the same size applicant can benefit by a cost savings in production, since the same size frame can be used for both embodiments. Obviously the length of each pair of cable 14, 14' could be increased to reduce the distance between the inner edges of the pair for the first embodiment of the invention.

There are many types of filter media that can be employed with this invention as the filter. Thus one can employ in the filter, filter media similar to those which are used in home heating and air conditioning units. Typically these are of fiberglass fibers and are considered by the industry to be disposable, while, hog hair or horsehair based filter media are washable and reusable. Flexible foam filters are also available in the marketplace. These are generally washable and reusable.

A preferred foam is Sorbacell (trademark of Scotfoam, Eddystone, Pa.) for its activated charcoal impregnated SiF foam. The Sorbacel 7 foam is a class of polyester or polyester based flexible open cell polyurethane foams having pores that can vary from 10 to about 70 average pores per linear inch (ppi). The foam is surface coated from a slurry with carbon (activated charcoal). Since the point of invention does not lie in the choice of foam or other filter media, further details about this product need not be set out.

The filter medium be it the Sorbacell foam, or any of the others aforementioned, cut into two half discs, designated 06 and 07. A small cutout 08 and 08' are made in the filter medium to accommodate the tubular conduit 04. The filter medium rests on the flanges as noted above, beneath the fingers 24, such that it is confined within the body portion 11, i.e. the frame, whereby air being forced up through the filter medium by the blades 03 will be cleansed and the filter will remain confined within the frame. Since the tips of the blades do not extend beyond the inner edge of the upstanding wall of the frame, the moving air is directed toward the filter medium.

Obviously the amount of cleansing is dependent upon the density of the filter and its ability to limit air flow and trap particulates. It is within the skill of the artisan to determine the optimum filtration characteristics needed for a particular environment. Thus the needs of a school gym may be different from those of a saloon.

While no health claims are made, in tests in the home of the inventor, a heavy smoker, significant improvement in the air quality has been noticed, as determined by a lack of the typical stale cigarette smoke odor.

It is seen that there is provided here a unique and low cost means of purifying the air in a room. While the embodiment discussed above utilizes a circular frame for the filter medium, a diagmond or square shape can also be employed, just so long as the rotating blades of the fan do not impinge upon the inner surface of the frame of the filter media.

Since certain changes may be made in the above apparatus without departing from the scope of the invention herein involved, it is intended that all matter contained in the above description and shown in the accompanying drawings shall be interpreted as illustrative and not in a limiting sense.

What is claimed is:

1. A filtration device for disposition over a ceiling fan, which fan includes a motor housing from which emanate a series of blades, and a tubular conduit to carry the wiring to a ceiling mounted electrical outlet, said device to be used in conjunction with said fan for cleansing a room's air comprising, a. a filter media frame comprising two interconnectable open topped halves having means adapted to fit abuttingly around the tubular conduit of a ceiling fan, said frame having means thereon for retaining a filter therein, said frame sized in diameter to be greater than the diameter of a pair of opposed blades of the fan upon which the device is disposed, b. means attached to said frame for securing said frame in a fixed position relative to said fan whereby a filter medium present in said frame is disposed above said fan, and a portion of said frame is spaced laterally from said blades.

2. The filtration device of claim 1 further including a filter disposed within said frame.

3. The filtration device of claim 1 wherein the means for securing the frame comprises mount means to connect the frame to the ceiling from which the ceiling fan is hung.

4. The filtration device of claim 1 wherein the means for securing the frame comprises mount means to connect the frame to the fan's tubular conduit.

5. The device of claim 2 wherein the filter medium of the filter is an activated charcoal impregnated foam.

6. The device of claim 2 wherein the filter medium of the filter is made of filter media used for air conditioner filters.

7. A device to be used in conjunction with a ceiling fan having a motor housing, a series of blades emanating therefrom, a tubular conduit carrying the wiring from said motor housing to a ceiling electrical outlet, which device is for cleaning a room's air of pollutants, when a filter is placed therein, and which device comprises:

a. a main body portion comprised of two interconnectable open topped mirror image halves, each of which includes an upstanding outer wall having an outer surface and an inner surface, and an upstanding inner wall connected to the terminii of the outer wall, an inwardly directed flange on the inner surface of said walls, spaced up from the bottom edge thereof, confining means spaced up from said flange, and inwardly directed from the inner surface of said outer wall, to retain a filter therebetween, a flange on at least a portion of said upstanding inner wall outwardly directed and normal thereto spaced up from the bottom edge of said inner wall, means on said body portion halves for joining one to the other releasably, b. means on said body portion for receiving mount means, c. mount means engageable with said outer wall for mounting the device in a fixed position relative to said fan.

8. The device of claim 7 wherein the mount means comprises at least two J-shaped hooks and ceiling mountable mount plates adapted to receive said J-shaped hooks.

9. The device of claim 7 wherein the mount means comprises at least two J-shaped hooks each having a centrally bored flat plate at one end, and a collar adapted to be retained on the tubular conduit of said fan, which collar includes a pin adapted to engage the bore of the flat plate of said J-shaped hooks.

10. The device of claim 7 further including an air filter disposed therein.

11. The device of claim 10 wherein the filter comprises an activated charcoal impregnated foam.

12. The device of claim 10 wherein the filter comprises an air conditioner filter's filter medium.

* * * * *